US005439106A

United States Patent [19]

Focke

[11] Patent Number: 5,439,106

[45] Date of Patent: Aug. 8, 1995

[54] BUNDLE PACKAGE FOR CIGARETTE PACKS AND PACKAGE BLANK

[75] Inventor: Heinz Focke, Verden, Germany

[73] Assignee: Focke & Co. (GmbH & Co.), Verden, Germany

[21] Appl. No.: 976,206

[22] Filed: Nov. 13, 1992

[30] Foreign Application Priority Data

Nov. 15, 1991 [DE] Germany ..... 41 37 643.9
Apr. 24, 1992 [DE] Germany ..... 42 13 489.7

[51] Int. Cl.[6] ..... B65D 85/10; B65D 5/00
[52] U.S. Cl. ..... 206/273; 229/159
[58] Field of Search ..... 206/271, 273, 274, 275, 206/256; 229/159

[56] References Cited

U.S. PATENT DOCUMENTS 3,027,998 12/1959 Ridgway .
3,256,983 6/1966 Lech ..... 229/159 X
3,404,829 10/1968 Stone ..... 229/159 X
3,469,765 9/1969 Mueller ..... 229/765
3,508,909 5/1950 Evans et al. ..... 229/159 X
4,804,138 2/1989 McFarland .

FOREIGN PATENT DOCUMENTS 399627 7/1909 France .
819495 9/1957 Germany .
2362512 6/1975 Germany .
9100634 5/1991 Germany .
835451 5/1960 United Kingdom .
1138875 1/1969 United Kingdom .
1238176 7/1971 United Kingdom .
2024172 1/1980 United Kingdom .
2101565 1/1983 United Kingdom .

*Primary Examiner*—Bryon P. Gehman
*Attorney, Agent, or Firm*—Sughrue, Mion, Zinn, Macpeak & Seas

[57] ABSTRACT

A cigarette carton made of thin cardboard, a carton blank and a method for producing the carton. The cigarette carton has reinforcements (16, 22) extending over entire surfaces in the region of closing tabs (17, 21) or insertion flaps, thereby facilitating the opening and reclosure of the carton.

13 Claims, 13 Drawing Sheets

Figure 1:
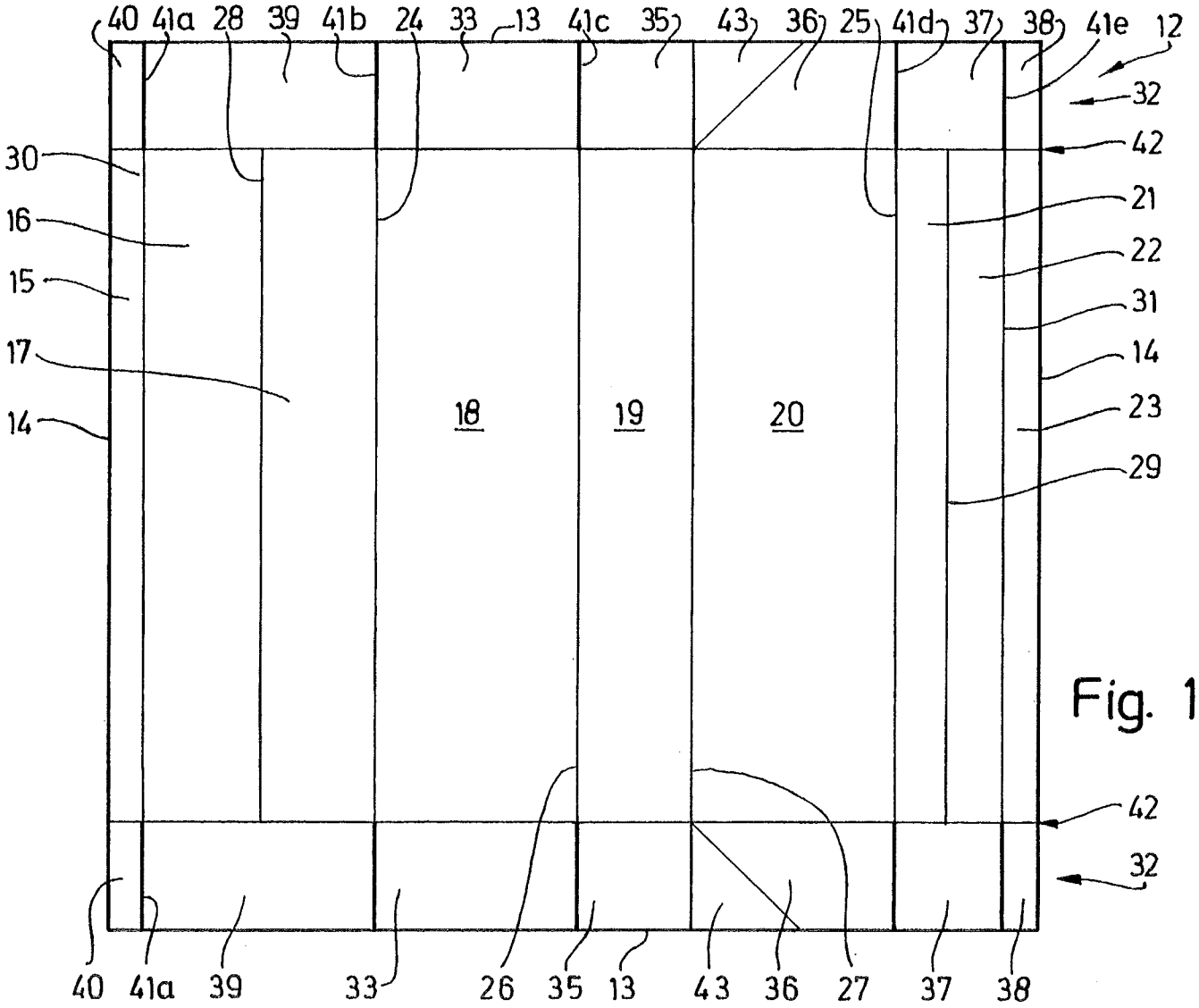

90
62
63
64
65
66
67
68
69
70
71
72
73
74
75
76
77
78
79
80
81
82
83
87
88
89
91
92
93
94

FIG.13a
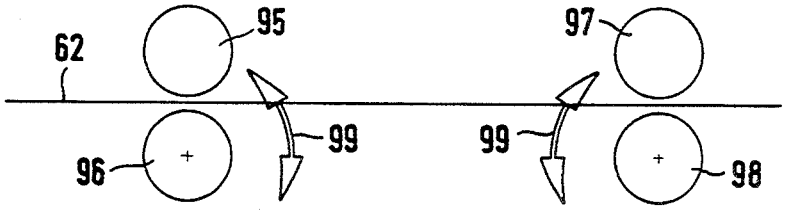
FIG.13b
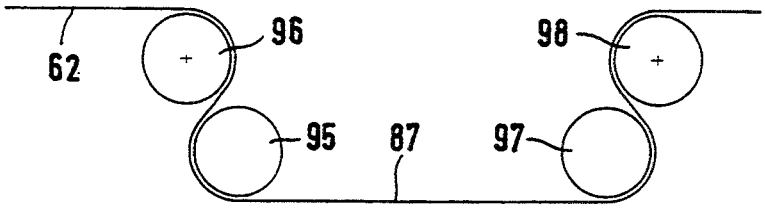
FIG.13c
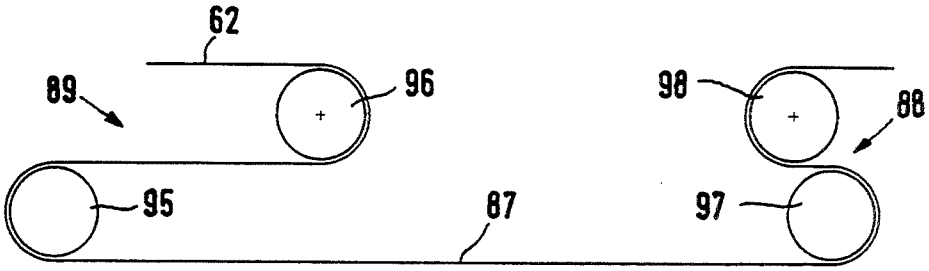
FIG.13d
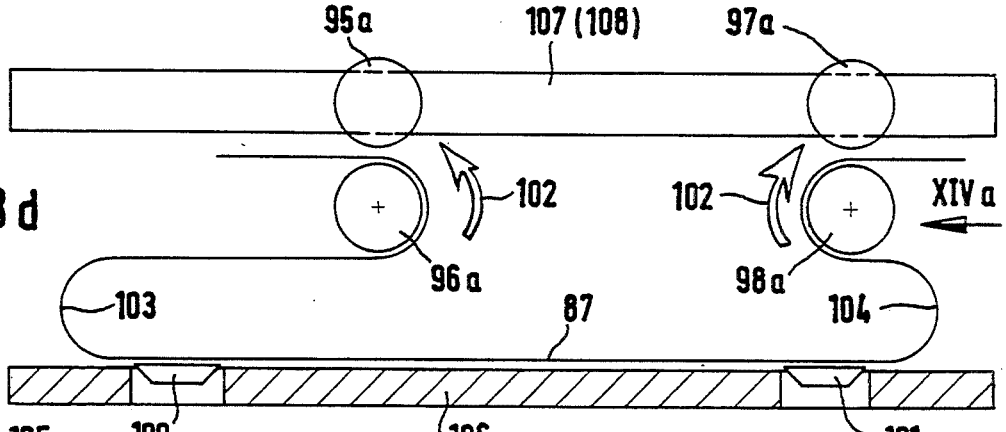
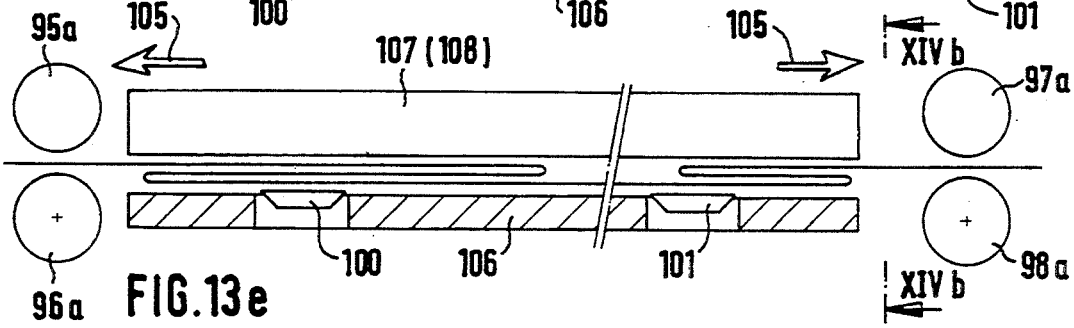
FIG.13e

BUNDLE PACKAGE FOR CIGARETTE PACKS AND PACKAGE BLANK

DESCRIPTION

The invention relates to a package, especially a bundle package for cigarette cartons, formed from a blank of thin packaging material, especially paper, which completely surrounds the package contents and forms a top wall, front wall, rear wall, bottom wall and end walls. The invention also relates to a blank for forming a package from thin packaging material and a method for producing a package and to a suitable apparatus.

The invention is primarily directed to forming greater bundles, socalled cigarette cartons, from individual cigarette packs. Prior art packages used for this purpose are either made from cardboard, i.e. relatively thick and expensive material which is unfavorable in terms of disposal, or they are formed from a light paper wrapper. Packages formed from paper wrappers are only stable to some extend in the closed condition. It requires costly and complicated measures to ensure that these packages retain some sort of stability after they have been opened and reclosed. It would be desirable to have a light and inexpensive package which could be opened and reclosed several times, if required. Some countries have tax provisions with respect to cigarettes which require an opening and reclosure of the package of cigarette cartons at some point on the way between the manufacturer and the retailer. In the USA, for example, the local wholesaler has to affix revenue stamps to the individual small packs. Naturally, the wholesaler needs to open and subsequently reclose the cigarette carton or bundle package for this purpose. This procedure must not affect the durability and stability of the package and should not be too labor-intensive.

It is the object of the present invention to create a package which is as inexpensive as possible and still exhibits an increased stability and can be reclosed, if required, without impeding its usability.

According to the invention, this object is attained by forming an insertion flap or closing tabs from the blank in the region of the top wall for the closure of the filled package, and by providing the insertion flap or the closing tabs with sheet-like reinforcements which are durably connected over their entire surface to the insertion flap or the closing tab and thus strengthen its rigidity. The insertion flap or closing tabs are subjected to increased stress during opening and reclosure and are prevented from tearing or the like by reinforcements provided in accordance with the invention.

Expediently, the reinforcements are formed from a plurality of interconnected, especially adhesively bonded layers of the bundle blank. As a result, reinforcements can be provided in specific defined regions by means of simple folding operations during the production of the package from a blank. The reinforcements are adhesively bonded to the insertion flap or the closing tabs over their entire surface. For the purpose of this invention, a bonding over the entire surface is also understood to mean a fine grid of connecting points or adhesive spots. The crucial point is the creation of the mechanical properties of a thicker layer.

A package in which strip-like portions along free edges of a pack opening are provided with reinforcements is of particular advantage. These reinforcements are preferably formed by folding over edge portions of the blank beyond the region of the closing tabs or the insertion flap towards the inside. Additional reinforcements are particularly useful within the regions near the pack opening.

In another embodiment of the invent ion, the closing tabs or insertion flaps are formed to have multiple layers, especially three layers by way of a Z-shaped folding of edge portions of the blank, and are preferably reinforced additionally by an inward folding of projecting end portions. Z-shaped folds can be made in a simple manner with only few working steps and result in three-layer closing tabs or insertion flaps. To permit an inward folding of projecting end portions, free legs of the Z-fold are formed to be longer. The freely projecting end portions can be folded around the Z-fold, so that altogether four layers rest on top of another.

The basic shape of a blank according to the invention for forming a package from thin packaging material is rectangular. To define a closing tab or an insertion flap, a hinge line is disposed parallel to an outer edge. Additionally, a folding line is disposed between the aforementioned hinge line and the aforementioned outer edge in order to define a reinforcement. A package with reinforced closing tabs or insertion flaps can be readily formed from a blank of this type.

It would also be possible to provide two hinge lines in order to form two closing tabs or insertion flaps. In this case, the blank would have one additional hinge line and one additional folding line.

A further blank according to the invention also has an originally rectangular shape. Side-by-side portions for forming a large side face (front wall), a bottom wall and another large side face (rear wall) are disposed approximately centrally and preferably in the longitudinal direction of the blank. Portions which adjoin each side face on the outside—i.e. which are located opposite the bottom wall—are disposed to each form a closing tab comprising a three-layer Z-fold. This blank can also be readily formed into a package in accordance with the invention.

The method according to the invention for producing a package is preferably based on a blank according to the invention and is adapted especially for the production of a package according to the invention. The method comprises the steps of folding edge portions inwards (until they rest against the blank), which portions have a width (width parallel to the hinge line) which preferably corresponds to the width of the completed package and which portions are located on both sides in the regions of ends of at least one hinge line disposed parallel to an outer edge; thereafter forming a closing tab or an insertion flap with a reinforcement by an inward folding (against the blank) about a folding line located between the hinge line and an outer edge; and subsequently completing the folding of the package which thereby assumes a cuboid shape.

A method according to the invention for producing a package having a Z-fold and preferably using a blank according to one or more of claims 7 to 10 is characterized in that, in order to form multilayer and especially three-layer portions of the future package, a loop is made in a continuous web of packaging material, such that two successive and opposedly directed Z-folds are formed. Accordingly, two Z-folds are formed simultaneously before any individual blanks are severed from the web of packaging material. As a result, this method is particularly effective.

Further advantageous embodiments of the invention are described in the other claims. These improvements are directed in particular to the attachment and arrangement of additional reinforcements, the design of suitable folding lines or folding edges, hinge lines and Z-folds, and to suitable blanks, different methods for producing packages and an apparatus for these methods.

Figure 2:
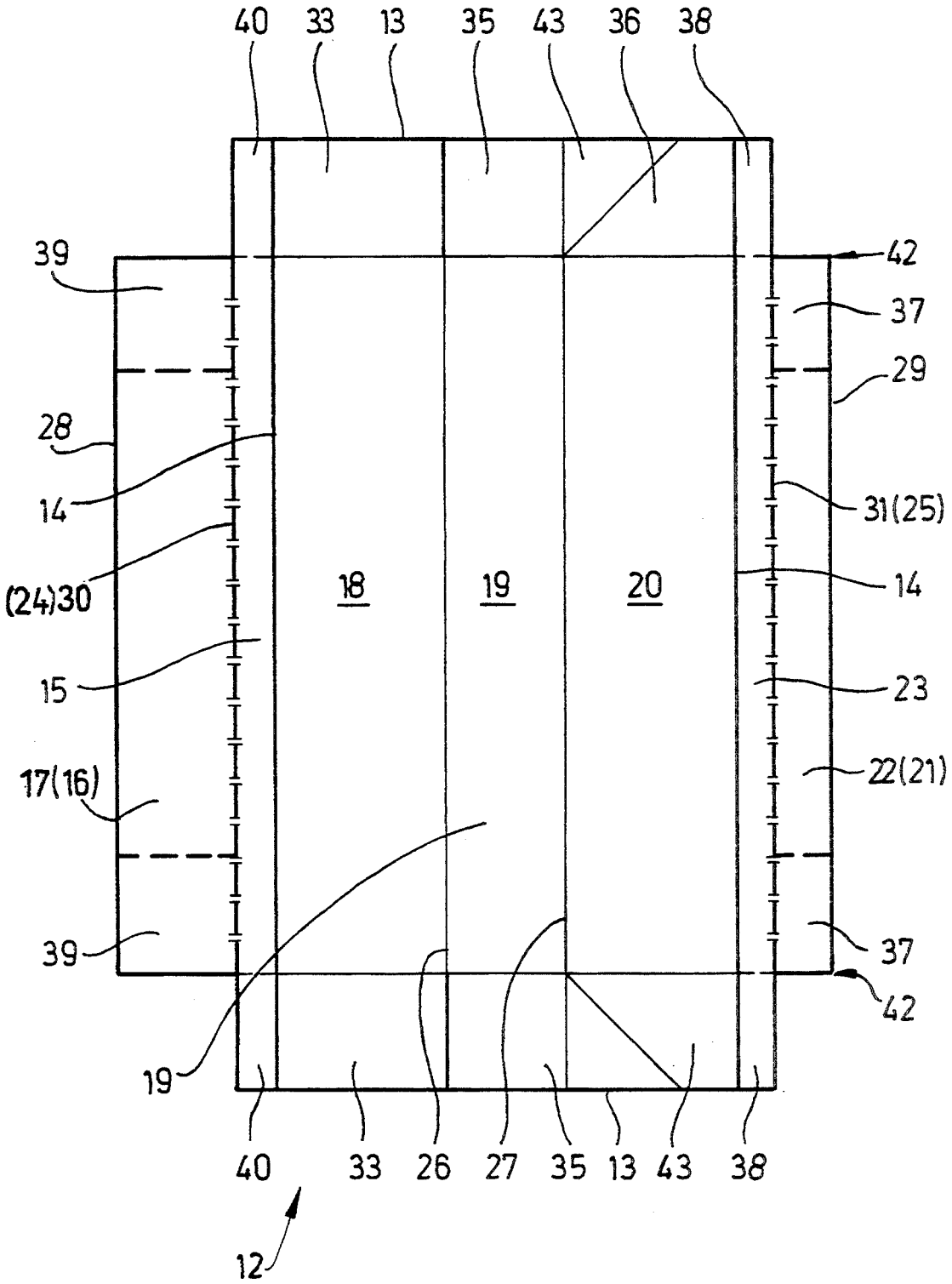
Figure 3:
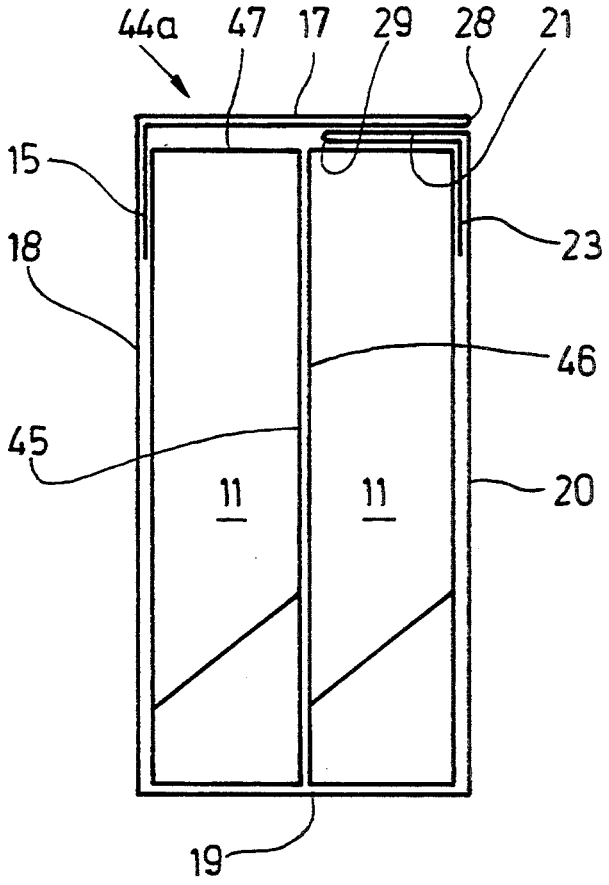
Figure 4:
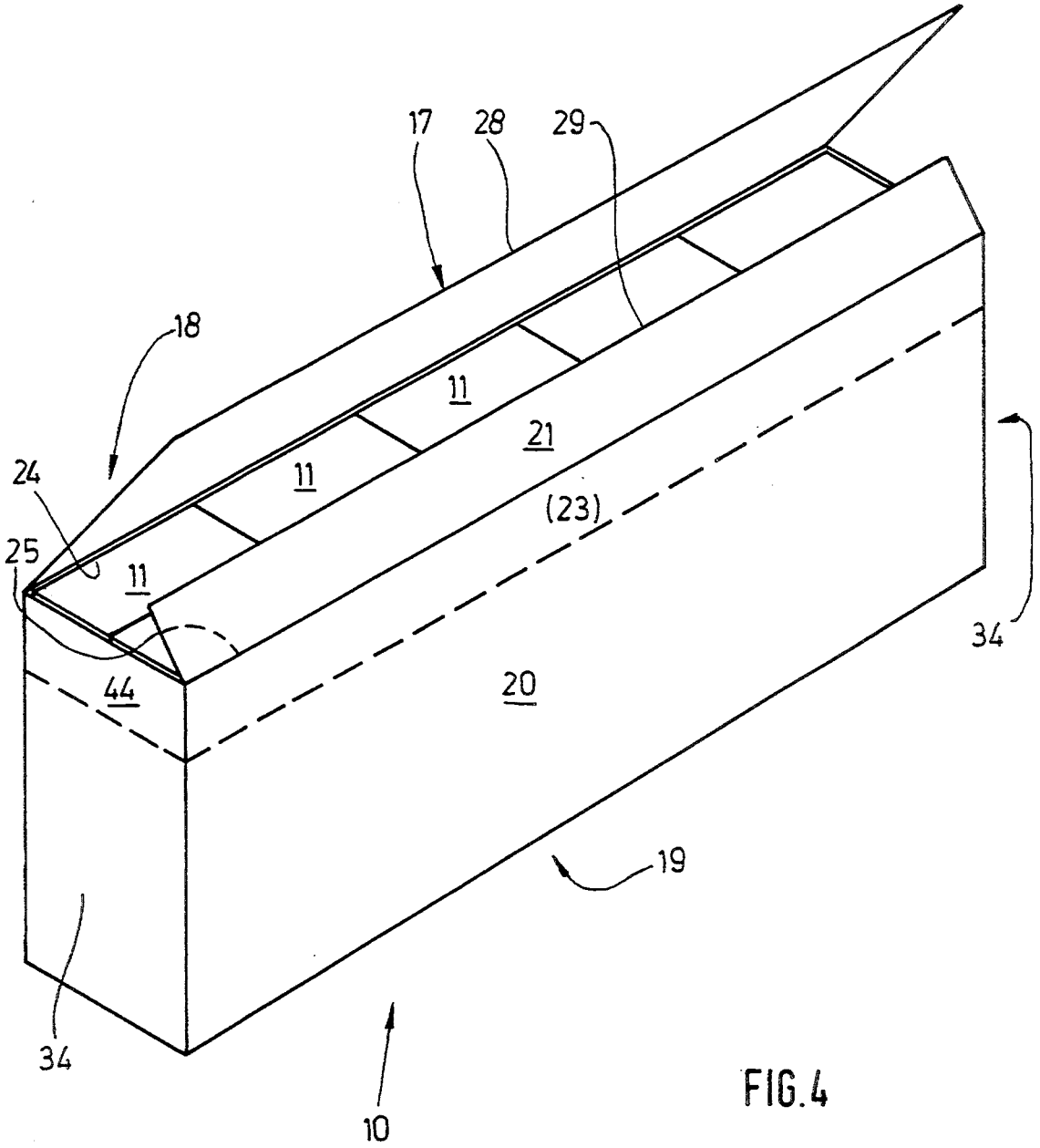
Figure 5:
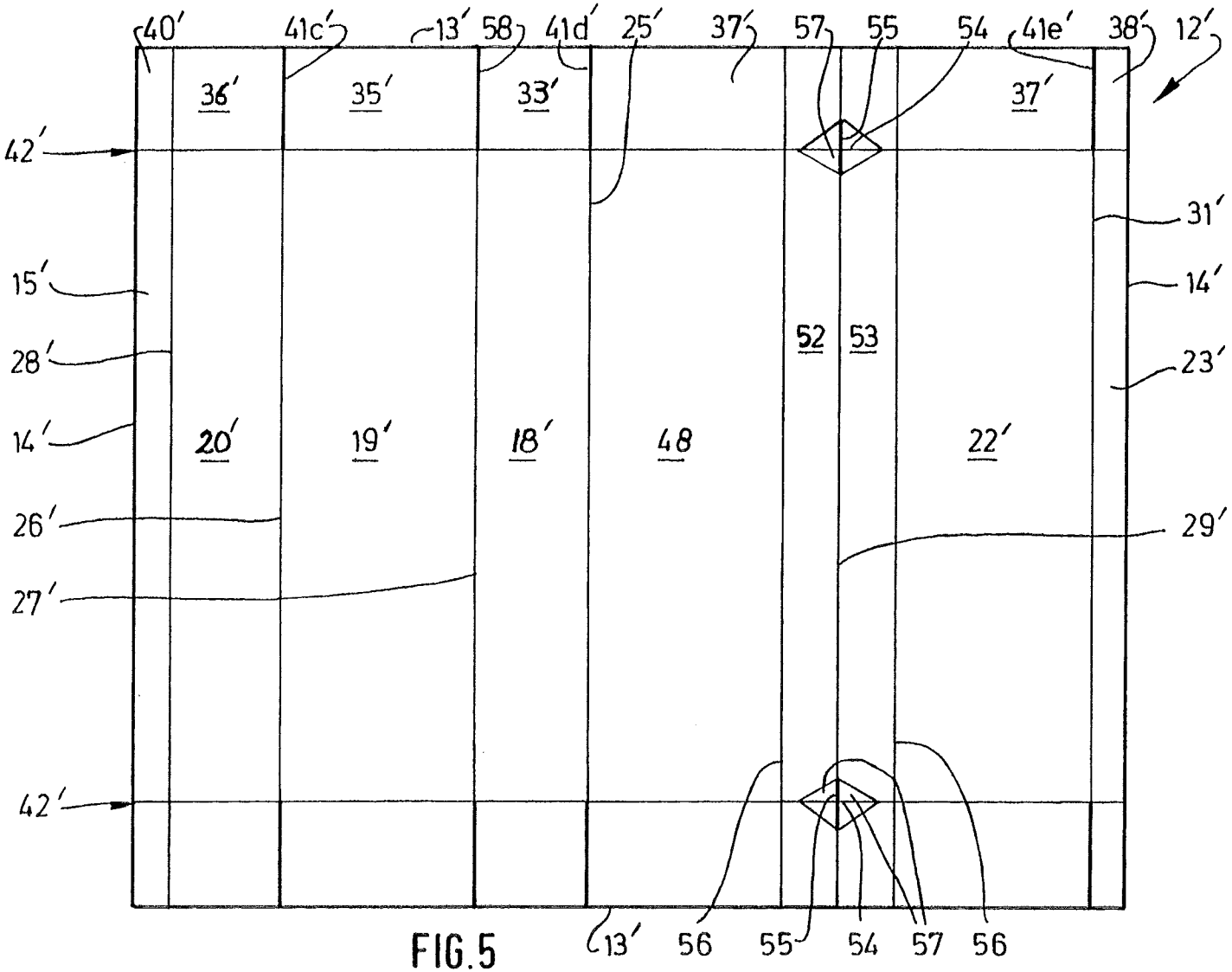
Figure 6:
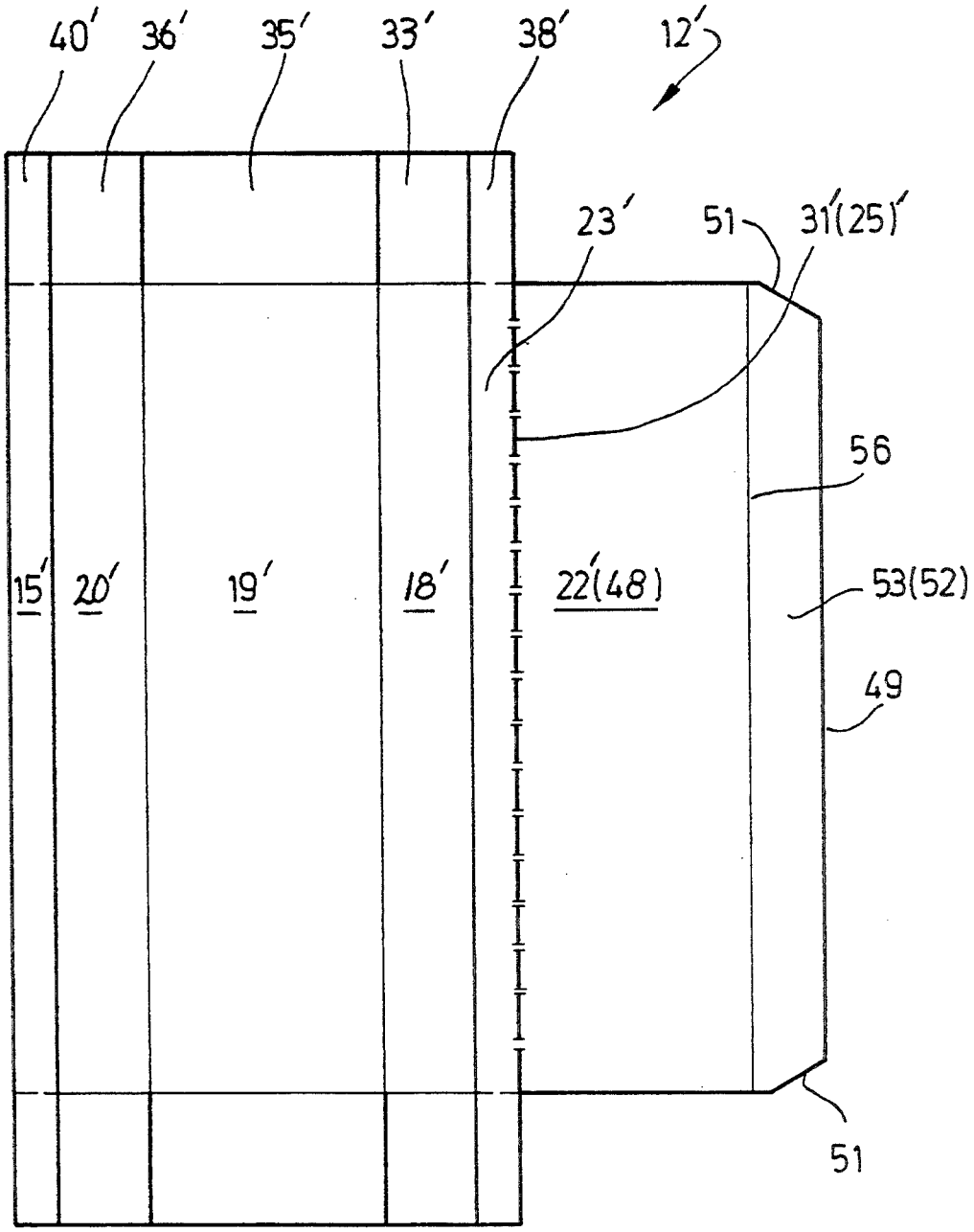
Figure 7:
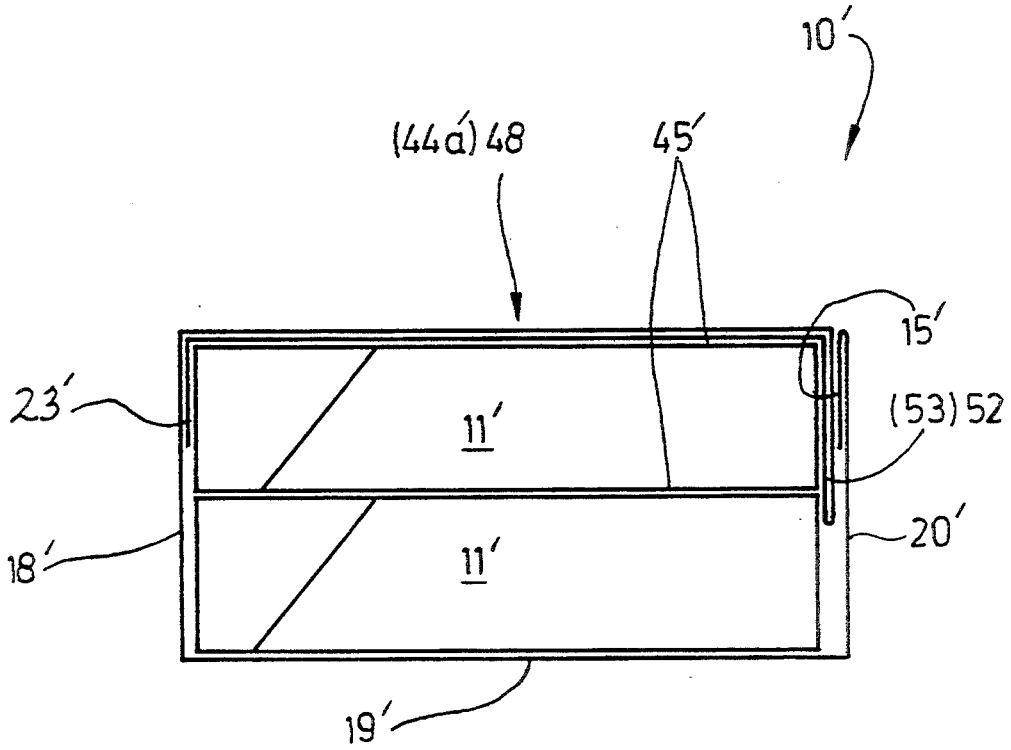
Figure 8:
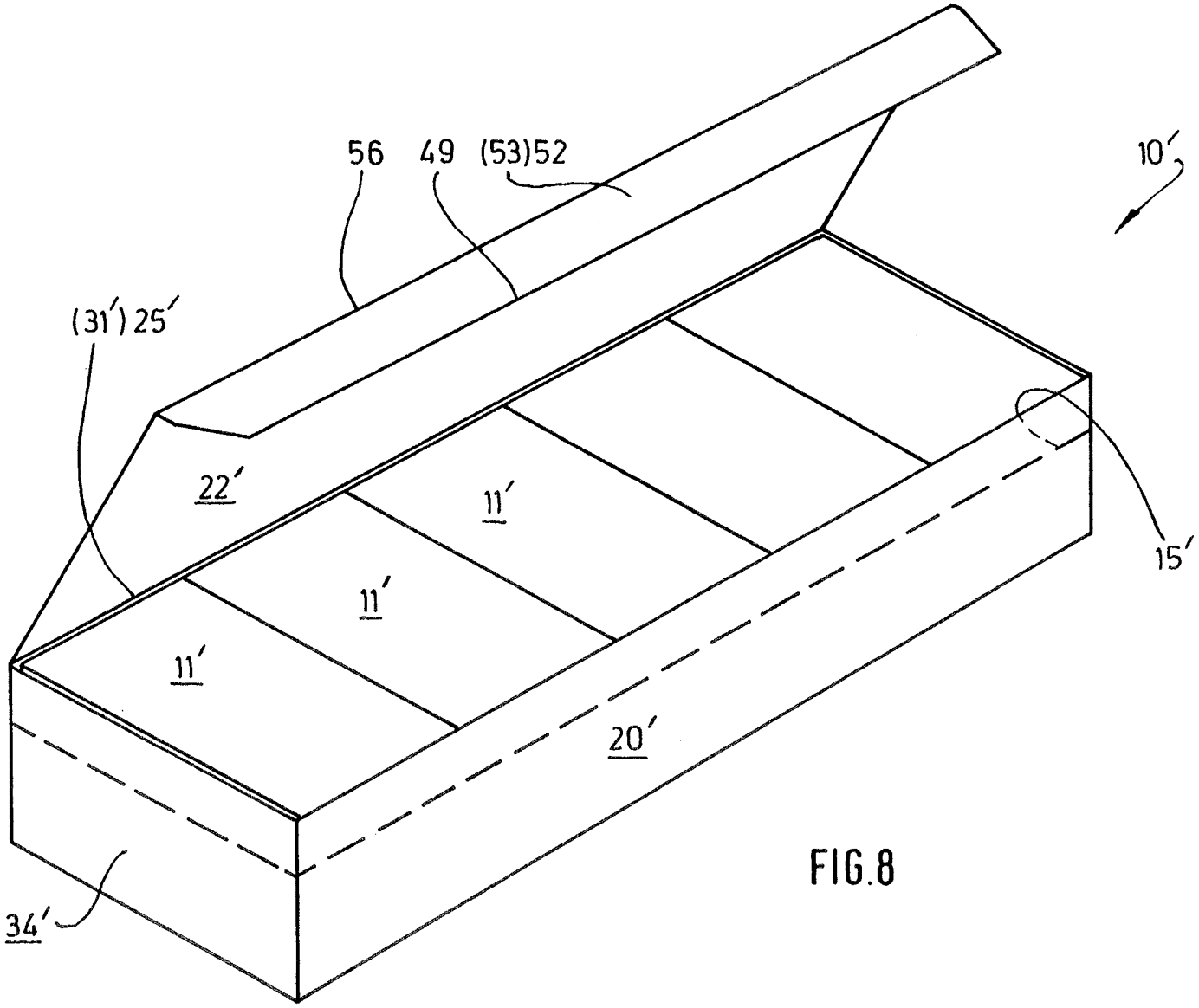
Figure 9:
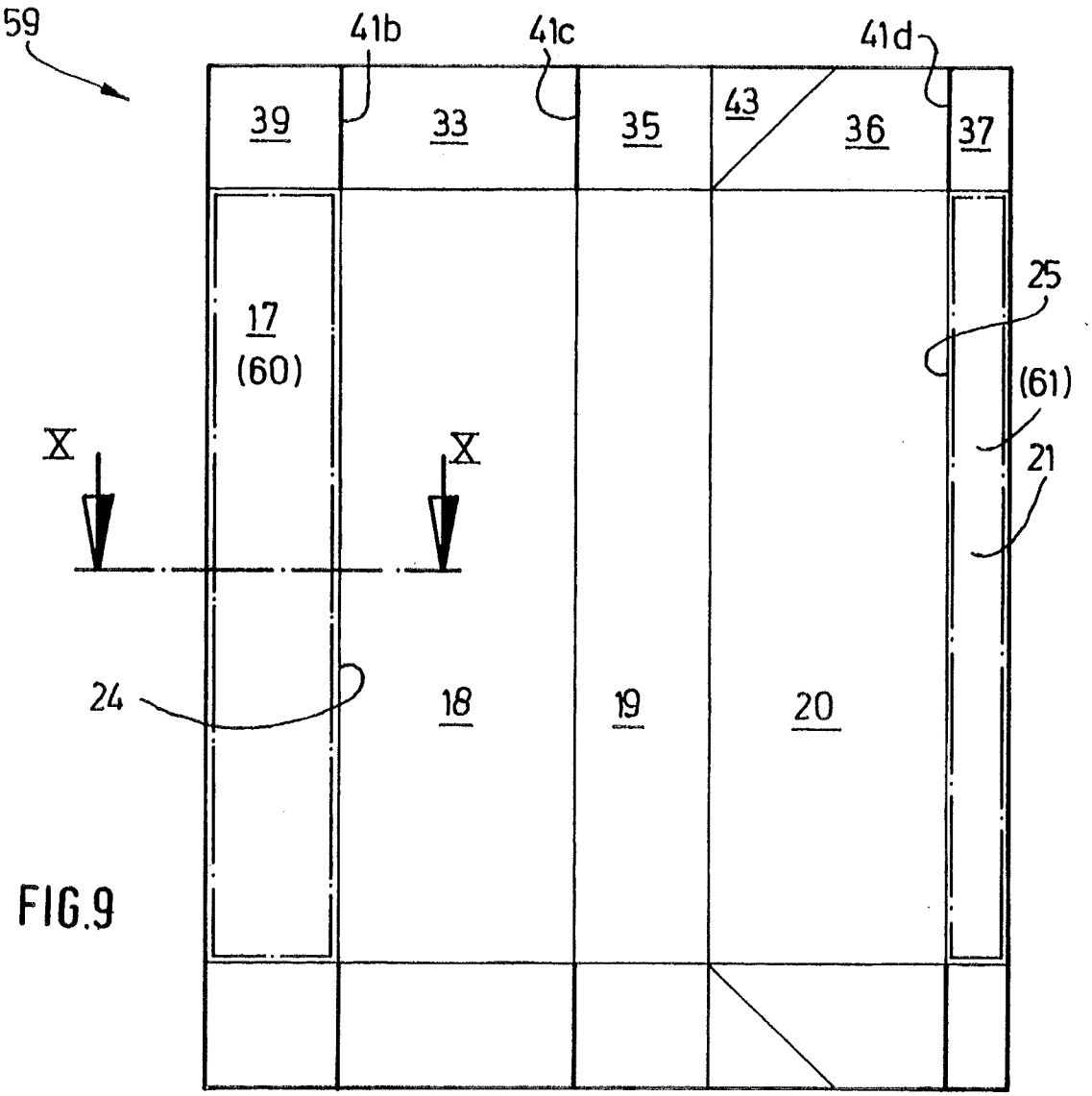
Figure 10:
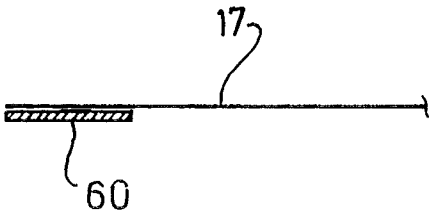
Figures 11A, 11B, 11C, 11D, 11E:
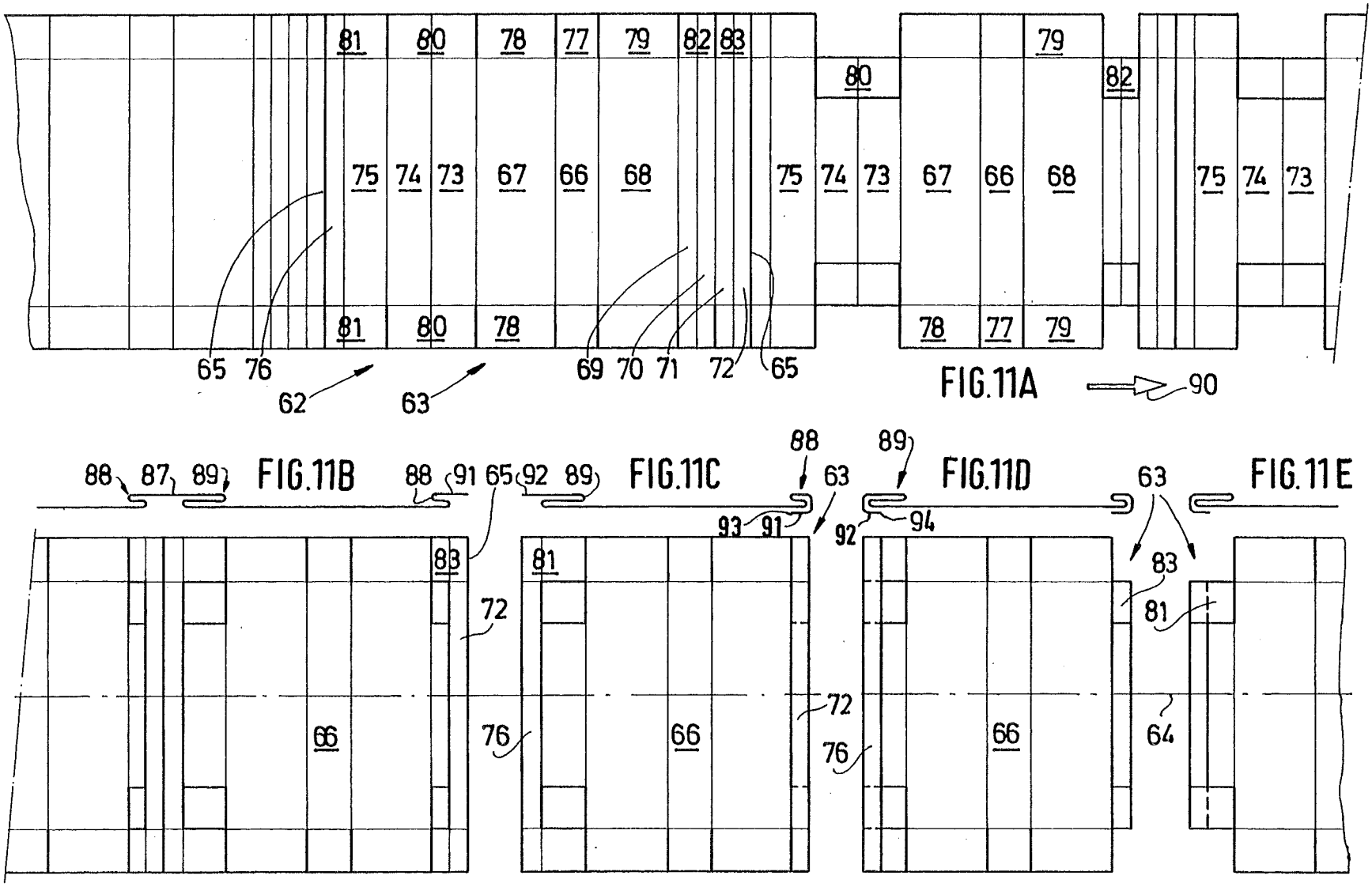
Figure 12:
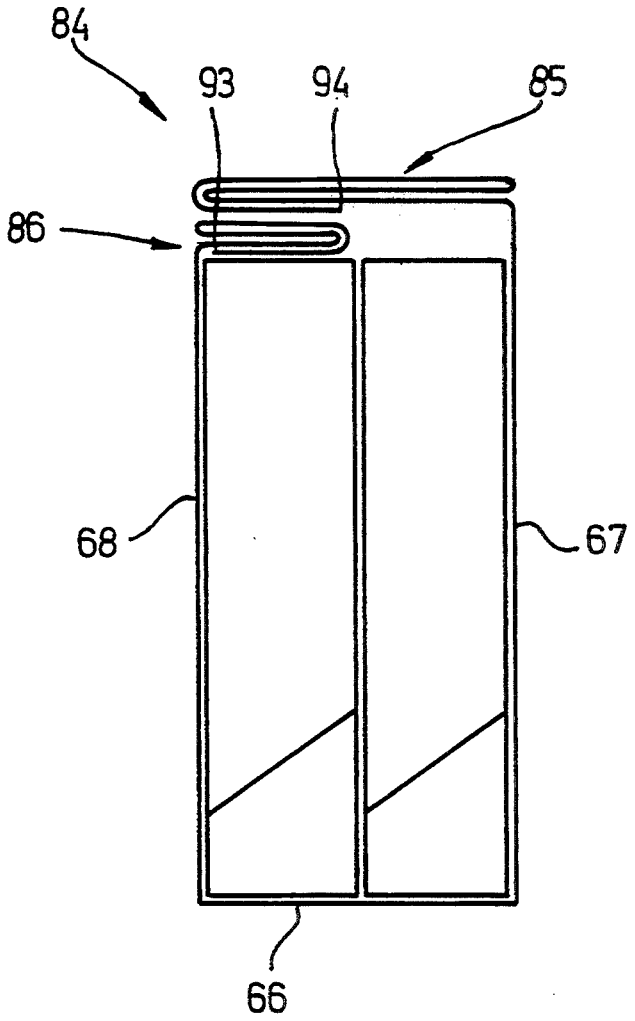
Figure 14A:
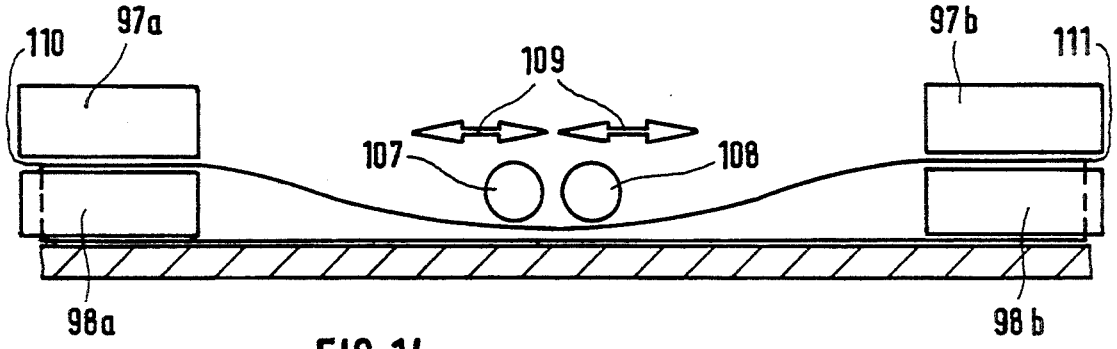
Figure 14B:
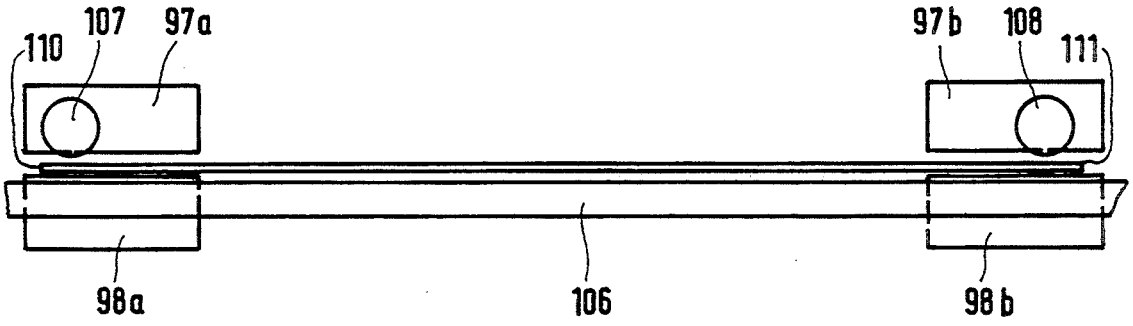

Preferred exemplary embodiments of the invention will be described below in detail with reference to the drawings, in which:

FIG. 1 shows a blank for a first embodiment of a package according to the invention which has two closing tabs, FIG. 2 shows the blank of FIG. 1 after it has been folded several times, FIG. 3 shows a cross section of a package in the closed condition which is formed from a blank according to FIG. 1, FIG. 4 shows a perspective view of a package according to FIG. 1 in the open condition, FIG. 5 shows a blank of another embodiment of a package according to the invention which has an insertion flap, FIG. 6 shows the blank of FIG. 5 after it has been folded several times, FIG. 7 shows a cross section of a package in the closed condition which is formed from a blank according to FIG. 5, FIG. 8 shows a perspective view of a package in the open condition which is formed from a blank according to FIG. 5, FIG. 9 shows a blank of another embodiment of the invention, FIG. 10 shows a section of the view of FIG. 9, taken along the line X—X, FIGS. 11*a* to 11*e* show a representation of successive processing steps for a web of packaging material comprising successive blanks which are connected to one another, FIG. 12 shows a cross section of a ready-folded, filled and closed pack, corresponding to the blank illustrated in FIGS. 11*a* to 11*e*, FIGS. 13*a* to 13*e* show a representation of the individual method steps and a corresponding apparatus for forming a loop with two oppositely situated Z-folds in the web of packaging material according to FIG. 11*b*, FIG. 14*a* shows a view in the direction indicated by arrow XIVa of FIG. 13*d*, FIG. 14*b* shows a view along line XIVb—XIVb of FIG. 13*e*.

The embodiment illustrated in FIGS. 1 to 4 will be described first. A package 10 for forming a cigarette carton in the form of a bundle of a plurality of individual cigarette packs 11 is produced from a rectangular blank 12. In particular, a cigarette carton comprises two rows of standard cigarette packs such as socalled hinge-lid packs. The blank 12 has a pair of opposite long blank edges 13 and a pair of opposite short blank edges 14. To define different package parts or walls, parallel folding lines extend from one long blank edge 13 to the other. Special folding lines will be described in more detail further below. The blank of FIG. 1 comprises, from left to right, the following package parts or walls:

Left edge reinforcement 15, left closing tab reinforcement 16, left closing tab 17, rear wall 18, bottom wall 19, front wall 20, right closing tab 21, right closing tab reinforcement 22 and right edge reinforcement 23. Each of these parts 15 to 23 directly adjoins an adjacent part and is rectangular in shape. The terms used for designating these parts relate to their position within the completed package.

A hinge line 24 is disposed between the left closing tab 17 and the rear wall 18. Accordingly, a hinge line 25 is located between the right closing tab 21 and the front wall 20. Both hinge lines 24, 25 are preferably perforated and form, so to speak, the pivot for the closing tabs 17, 21.

Folding lines 26, 27 which are provided for folds through 90° are disposed between the rear wall 18, the bottom wall 19 and the front wall 20. A folding line 28 for a 180° fold is disposed between the left closing tab 17 and the left closing tab reinforcement 16. A folding line 29 which has the same function is located between the right closing tab 21 and the right closing tab reinforcement 22. Folding lines 30, 31 which lie on the hinge lines 24, 25 in the completed package 10 are located between the left edge reinforcement 15 and the left closing tab reinforcement 16 as well as between the right folding tab reinforcement 22 and the right edge reinforcement 23.

The partition of lateral portions 32 which directly adjoin the long blank edges 13 is partly different from the partition of the aforedescribed walls 15 to 23. Portions which are located adjacent the rear wall 18 and adjoin the long blank edges 13 are designated as end tabs 33. Altogether three tabs are involved in the forming of each end wall 34 in the completed package, in particular, viewed from left to right, the aforementioned end tabs 33, the bottom wall tabs 35 and the front wall tabs 36 which adjoin one another.

Reinforcing tabs 37 are located between the long blank edges 13 and the right closing tab 21 in conjunction with the right closing tab reinforcement 22. The corner portions of the blank 12 on the top right and bottom right are edge tabs 38. Correspondingly, left reinforcing tabs 3 9 and left edge tabs 40 are formed to the left of end tabs 33 with respect to the left closing tab 17, the left losing tab reinforcement 16 and the left edge reinforcement 15.

A special feature of the lateral portions 32 are their incisions 41*a* to 41*e* which are indicated by thick solid lines and are directed parallel to the folding lines 26 to 29. Incision 41*a* is in alignment with the folding line 30, incision 41*b* with the hinge line 25, incision 41*c* with the folding line 26, incision 41*d* with the hinge line 25 and incision 41*e* with the folding line 31. Folding lines 42 are disposed parallel to the long blank edges 13 in order to delimit the lateral portions 32 towards the center of the blank.

FIG. 2 illustrates the b lank of FIG. 1 after it has been folded several times. As a result, the closing tab reinforcements 16, 22 rest on the closing tabs 17, 21. For this purpose, the right and the left reinforcing tabs 37, 39 are folded from their position of FIG. 1 inwards, such that they come to rest on the closing tabs 17, 21 and the closing tab reinforcements 16, 22, in particular in the regions of the closing tabs and closing tab reinforcements which are adjacent to the folding lines 42. Subsequently, the left closing tab reinforcement 16 is folded about the folding line 28 and onto the left closing tab 17. In this process, the folding line 30 comes to rest on the hinge line 24, just like the left edge reinforcement 15 and the left edge tab 40 come to rest on the rear wall 18 and the end tab 33, respectively. Similar to the aforedescribed folding, the right closing tab reinforcement 22 illustrated on the right hand side in FIG. 1 is folded onto the right closing tab 21. As a result of the folding operations, the folding lines 28, 29 are now located on the outside and form boundary edges for the closing tabs 17, 21. As is evident from FIG. 2, the folding lines 30, 31 are preferably perforated, similar to the hinge lines 24, 25.

In the next step, the blank is folded about the folding lines 26, 27. This is preferably accomplished by feeding a group of cigarette packs in such a way that the blank 12 is folded around the pack group in a U-shaped manner, so that the rear wall 18 and the bottom wall 20 rest against the front and rear sides of the cigarette packs.

Thereafter, the end walls 34 are folded. For this purpose, a tab formed from bottom wall tab 35 and front wall tab 36 is folded inwards. In this process, gussets 43 come to lie between the tabs 35, 36. Finally, the end tabs 33 are folded against the aforementioned tabs 35, 36. The last two folding steps may also be conducted in reverse order.

The ready-folded package 10 has particularly two outstanding features. One consists of the reinforced closing tabs 17, 21 which rest on top of one another when the package is closed and are connected for example by adhesive bonding. It is possible to open the package, either because a readily releasable adhesive has been used or by tearing the closing tabs 17, 21 along the perforated folding lines 30, 31 and hinge lines 24, 25. The package may be reclosed by adhesively bonding the closing tabs again or by connecting the torn closing tabs to the package with an adhesive tape.

The other outstanding feature is a reinforced edge which extends circumferentially in the region of the pack opening. This edge is formed from the left edge reinforcement 15, the right edge reinforcement 23 and, in the region of the end walls 34, from the edge tabs 38, 40. The aforedescribed edge reinforcement even forms four layers in the region of each end wall 34. Such a four-layer portion formed from edge tabs 38, 40 is designated 44 in FIG. 4.

Another special feature is an additional reinforcement of the closing tabs 17, 21 in regions which adjoin the folding lines 42. As a result of the inward folding of the reinforcing tabs 37, 39 as described above, four layers are formed in these regions as well.

FIG. 3 illustrates the individual layers in the region of the closing tabs 17, 21. The greater left closing tab 17 extends from the rear wall 18 to the front wall 20 and forms a top wall 44*a*, whereas the smaller right closing tab 21 only reaches approximately half as far. The individual cigarette packs 11 are disposed in the package 10 in such a way that several packs are located next to one another—side wall by side wall—and two packs rest against one another—front side 45 against rear side 46. End sides 47 are located at the opening side of the package 10, i.e. below the closing tabs 17, 21.

FIGS. 5 to 8 illustrate another embodiment of the invention. In contrast to the previously described embodiment, this embodiment has only one closing tab which takes the form of a closing flap 48. In FIGS. 5, 6, this insertion flap is disposed in the right hand region of the blank 12'. Besides, the blanks 12 and 12' substantially correspond to one another. Special features of the embodiment of FIGS. 5 to 8 will be described in the following.

Because there is no left closing tab, the left edge reinforcement 15' directly adjoins the rear wall 18', and the left edge tabs 40' directly adjoin the end tabs 33'. Moreover, the height-width ratio of the completed package 10' is different to that of the package 10 of the first embodiment. It is evident from FIG. 7 that the cigarette packs 11' are directed upwards to the pack opening, i.e. to the the closing flap 48 or the top wall 44*a'* with their large front sides 45'. Accordingly, the bottom wall 19' is greater than rear wall 18' and front wall 20'. This ratio of sizes is exactly inversed in the embodiment of FIGS. 1 to 4.

When the package is formed from the blank 12', reinforcement tabs 37' are—like the right reinforcement tabs 37 folded inwards to start with. Thereafter, the closing flap reinforcement 22' is folded onto the insertion flap 48 and the edge reinforcement 15' onto the rear wall 18'. In this process, the edge tabs 38' come to rest on the front wall tabs 36' and the edge tabs 40' on the front wall tabs 33' (see FIG. 6). The folding line 31' lies on the hinge line 25' and bounds the closing flap 48.

The folded closing flap 48 of FIG. 6 has bevels 51 at each end of the free edge 49. An insertion flap 52 extends between these bevels and is reinforced by an insertion flap end reinforcement 53 which, in FIG. 5, is located between the insertion flap 52 and the closing flap reinforcement 22'. The bevels 51 are formed by a cut 55 along the folding line 29' which is applied at each point of intersection 54 with the folding lines 42'. Additional folding lines are disposed around the point of intersection 54 in a diamond-shaped manner, such that the transverse dimension of the diamonds extends maximally over the length of the cuts 55 and the longitudinal dimension does not extend further than up to adjacent folding lines 56 which delimit the insertion flap 52 or the insertion flap end reinforcement 53. After the reinforcing tabs 37' have been folded over, the bevels 51 are created by an inward folding of corners 57 prior to an inward folding of the closing flap reinforcement 22'. After the closing flap reinforcement 22' has been folded onto the insertion flap 48, the package is folded around a group of cigarette packs and thus completed.

In the exemplary embodiment of FIGS. 5 to 8, the closing tab, which takes the form of an insertion flap 48, is also reinforced over its entire surface and the pack opening is marginally reinforced. FIG. 7 illustrates that the insertion flap 52 is inserted in the region of the front wall 20' between superposed cigarette packs and the front wall 20'.

The end walls 34 also comprise a special feature. The bottom wall tabs 35 are separated from the-front wall tabs 36 by cuts 58, such that the end walls 34' are formed without any gussets from the tabs 33', 35', 36' when they rest on top of one another. As a result of the edge tabs 38 40', the end walls 34' have multiple layers in the region of the edge tabs, in particular three layers, and in the region of an overlap of the end tab 33' and the front wall tab 36' they have six layers.

FIGS. 9 and 10 illustrate an embodiment which is similar to that of FIGS. 1 to 4 in terms of use. Instead of the reinforcements 16, 22 of the first embodiment, the embodiment of FIGS. 9 and 10 has separate reinforcing strips 60, 61 which are affixed individually to a blank 59. Any portions which correspond to those of FIG. 1 have been provided with the same reference numerals in FIGS. 9, 10. The reinforcing strips 60, 61 are mad e of cardboard, thin paperboard or the like and are preferably adhesively bonded to the closing tabs 17, 21 and nearly cover the entire surface of these closing tabs. The reinforcing strips 60, 61 may be affixed to the front and/or rear side of the blank 59. Since there are no edge reinforcements 15, 23 and no closing tab reinforcements 16, 22, the edge portions 38, 40 are eliminated as well. Besides, the reinforcing tabs 37, 39 are only as wide as the closing tabs 17, 21. Just like in the other embodiments, it is preferred to first of all fold the reinforcing tabs 37, 39 inwards at the beginning of the folding process, prior to any other folding step.

FIGS. 11*a* to 11*e* illustrate a web of packaging material 62 which takes the form of a continuous web to start with. The web of FIG. 11*b* is a continuation of the web of FIG. 11*a*. FIGS. 11*c*, 11*d* and 11*e* show blanks 63 which have been severed from the continuous web of material 62. In the upper region of each of FIGS. 11*b*, 11*c*, 11*d* and 11*e*, the web of material 62 or the blanks 63 are shown in cross section. The cross-sectional view is taken along line 64.

The size and shape of an unfolded flat blank is illustrated in FIG. 11*a*. The entire blank is located between the solid lines which are the severing lines 65. A narrow bottom wall 66 is disposed approximately in the center of the blank, i.e. slightly offset to the right of the center of the blank. Side faces acting as rear wall 67 and front wall 68 adjoin to the left and right of this bottom wall, respectively. Three successive narrow strips 69, 70, 71 of equal size adjoin the front wall 68 on the right. A further strip 72 of equal size forms the right edge of the blank.

Three strips 73, 74, 75 of approximately equal size adjoin the rear wall 67 on the left hand side. A further strip 76 forms the left edge of the blank. As a result, a strip 72 and a strip 76 are linked to one another in the region of every severing line 65. Thin folding lines are sketched between the walls 66, 67, 68 and strips 69 to 76 and extend transverse to the longitudinal direction of the web of material 62.

End tabs 77, 78, 79 which will form the end walls in the completed package adjoin on the outside of the walls 67, 68, 69, i.e. at the lateral edges of the web of material 62. A common folding tab 80 laterally adjoins the strips 73, 74. Accordingly, one folding tab 81, 82 and 83 is assigned to two strips 75, 76 and 69, 70 and 71, 72 on each side. The end tabs 77, 78, 79 and the folding tabs 80 to 83 are separated from one another by cuts. In FIGS. 11*a* to 11*e*, the cuts are illustrated by thick solid lines.

The package 84 which is to be made from the web of material 62 is illustrated in FIG. 12. A right closing tab 85 and a left closing tab 86 located thereunder are illustrated in the upper region of the package. Both tabs are, at least partially, four-layer tabs as a result of a Z-fold with an additional tuck. The procedure of forming such closing tabs is described in the following, again with reference to FIGS. 11*a* to 11*e*.

The aforedescribed folding lines and cuts for severing the tabs 77 to 83 are disposed in the continuous web of packaging material 62 between the walls or strips 66 to 76. The severing lines 65 which define a blank 63 are marked but not yet cut.

In a first step, the folding tabs 80 and 82 are folded inwards through 180°, such that they come to rest on the strips 73, 74 and 69, 70.

In a following step (FIG. 11*b*), a loop 87 is formed in the continuous web of material 62. This means that a part of the web of material 62 is moved out of the conveying plane of the web of material by suitable means and is set to protrude partly against the conveying direction and partly in the conveying direction of the web of material 62. Consequently, two opposed Z-folds 88, 89, each having three superposed layers, are formed. The conveying direction of the web of packaging material 62 is indicated by arrow 90 in the Figures. Accordingly, the left end in FIG. 11*b* is a continuation of the right end in FIG. 11*a*.

The aforedescribed looping of the web contracts the web of material 62 in the region of each severing line 65, in particular in such a way that the strips 69, 70, 71 rest on top of one another and form the Z-fold 88 and the strips 73, 74 , 75 form the Z-fold 89. As a result of these loops, the gaps in the lateral contour of the web of material 62 which were formed by the inward folding of the tabs 80 and 82 disappear.

In a following step, one blank at a time is severed along the severing line 65. This severing step is illustrated between FIGS. 11*b* and 11*c*. As a result, the loop 87 is severed as well. The strip 72 of Z-fold 88 now forms the end portion 91 adjoining the severing cut 65. A similar outwardly projecting end port ion of the Z-fold 89 is designated 92.

In a further step between FIGS. 11*c* and 11*d*, the aforedescribed end portions 91, 92 are folded inwards and around the respective Z-fold 88, 89 through 180°. As a result, four layers rest on top of one another in the region of the Z-fold 88. In the region of Z-fold 89, the four layers at least partly rest on top of one another, depending on the dimensions of the end portion 92.

Finally, the already folded folding tabs 81 and 83 are folded inwards from the lateral edge of the web of material 62 through 180° in another step (between FIGS. 11*d* and 11*e*).

Subsequently, the blanks which have been prepared in the aforedescribed manner are folded to form the finished package and are filled.

The aforedescribed method starts out with a continuous web of packaging material 62. Individual blanks are not severed until the loop 87 has been formed. Confronting edges 93, 94 of adjacent successive blanks are preferably processed in the same process step. The end portion 91 of the blank in FIG. 11*c*, for example, is folded together with the end portion 92 of the blank in FIG. 11*d*.

As a result of the described inward folding of the end portions 91, 92, the free edges 93, 94 are hidden when the closing tabs 85, 86 are closed (FIG. 12).

The process of forming loops as described in conjunction with FIG. 11*b* is conducted in a special way. Reference is made to FIGS. 13*a* to 13*e*. In FIG. 13*a*, the continuous web of packaging material 62 is illustrated by a solid line. The web 62 is guided through between the rollers 95, 96 of a first pair of rollers. Spaced apart from this first pair of rollers, another pair of rollers 97, 98 is disposed in like manner. The lower rollers 96, 98 are mounted fixedly transverse to the web 62 in a direction lying in the image plane and are marked with a central small cross. The upper rollers 95, 97 can be moved into the conveying plane of the web of material 62 in the direction indicated by arrows 99.

FIG. 13*b* illustrates the start of a loop-forming step. The rollers 95, 97 have been moved into the web 62 in order to form the loop 87.

The Z-folds 88, 89 are created by a further pivoting of the rollers 95, 97 and a movement of these rollers parallel to the conveying plane of the web 62. According to FIG. 13*c*, the roller 95 is moved further away from its corresponding roller 96 than the roller 97 from roller 98. As a result, Z-folds of unequal width are formed, corresponding to the width of, on the one hand, the strips 73, 74, 75 and, on the other hand, 69, 70, 71.

According to FIG. 13*d*, the loop 87 is retained in the position of FIG. 13*c* by suction holders 100, 101 while the rollers 95, 97 pivot back in the direction indicated by arrows 102 to their initial position (FIG. 13*a*). The suction holders 100, 101 act upon the web near the respective lower deflection points 103,104 of the Z-folds 89, 88 in the region of the straight web section which is already identified as loop 87, parallel to the conveying plane of the web of material 62.

Finally, the pairs of rollers 95, 96 and 97, 98 are moved away from one another along the conveying plane of the web of material 62 (arrows 105), such that the Z-folds 88, 89 are accessible. The different layers of the web of material are then folded or pressed into the position illustrated in FIG. 13*e* by a flattening unit. The configuration of the web according to FIG. 13*e* thus corresponds to the representation in FIG. 11*b*. The process is continued with the further steps as described above, for example with the step of separating the blanks and folding over the end portions 91, 92.

The abovementioned flattening unit takes the form of an ironing plate 106 and the suction holders 100,101 are embedded in the top surface of this plate. The ironing plate 106 extends in the conveying direction over a length which is slightly greater than the length which would be required for the Z-folds. The width of the ironing plate 106 reaches beyond the width of the web 62 (see FIG. 14*b*).

The ironing plate 106 interacts with a pair of rolls 107, 108 which are located side-by-side above the web parallel to the conveying direction of the web and are movable transverse to the conveying direction of the web along the arrows 109. At the same time, the rolls 107,108 are lowerable in the direction towards the ironing plate 106, so that they exert a pressure on the ironing plate 106 and thus already form the final Z-fold of the blank in this region when the rolls 107,108 are located in the position of FIG. 14*a* which is central relative to the web 62.

FIGS. 14*a*, 14*b* illustrate another special feature which has not been mentioned in the foregoing. In this case, the rollers 95 to 98 are not continuous in the direction transverse to the web 62, but are divided, such that each of the rollers 95 to 98 illustrated in FIGS. 13*a* to 13*b* does, in fact, consist of two coaxial short edge rollers 95*a* , 95*b*, 96*a*, 96*b*, 97*a*, 97*b*, 98*a*, 98*b*. According to FIGS. 14*a* and 14*b*, the edge rollers are disposed such that they act upon the web in the region of web edges 110,111. The clearance formed in this manner between two edge rollers 95*a*, 95*b* and, correspondingly, between the other edge rollers is used for the movement of the rolls 107,108 in the lowered position in order to form folding edges of the Z-folds. To change from the position of FIG. 14*a* to the position of FIG. 14*b*, the edge rollers 95*a* to 98*b* are moved apart in the directions indicated by arrows 105, so that the rolls 107, 108 fit lengthwise between the edge rollers when they move transvere to the web. Subsequently, the ironing plate 106 is lifted slightly, together with the rolls 107,108, up to the original conveying plane of the web 62 (see FIG. 13*a*).

The rollers 95 to 98 or edge rollers 95*a* to 98*b* as well as the rolls 107,108 and the ironing plate 106 are moved by suitable mechanical drives. In the interest of clarity, these drives are not shown in FIGS. 13*a* to 14*b*. The rollers 95, 97 may for example pivot about the rollers 96, 98 on appropriate levers. A combined pivoting and pushing movement (extension of the levers) permits a movement of the rollers 95, 97 parallel to the web 62. The same applies to an embodiment in which the rollers take the form of edge rollers 95*a*, 95*b*. The rolls 107,108 and the ironing plate 106 can be moved accordingly. The drives may for example take the form of electric stepping motors, linear motors and hydraulically or pneumatically working piston-cylinder units.

The aforedescribed embodiment may also be modified such that the edge rollers 95*a* to 98*b* or the rollers 95 to 98 are movable perpendicular to the conveying plane. In this case, the position of FIG. 14*a* arrives at the position of FIG. 14*b* by a downward movement of the edge rollers 95*a* to 98*b* or rollers in the direction towards the ironing plate 106, thereby taking along the web 62.

I claim:

1. A cuboid bundle package for cigarette cartons, formed from a paper blank (12, 12') which completely surrounds contents of the package and forms a top wall (44*a*, 44*a'*), a front wall (20, 20'), a rear wall (18, 18'), a bottom wall (19, 19') and end walls, wherein:

a) the package comprises a first closing flap (17, 48, attached to the rear wall (18, 18'), for forming the top wall (44*a*, 44*a'*);

b) the first closing flap, which comes to rest in the plane of the top wall (44*a*, 44*a'*) when the package is closed, has a reinforcement sheet (16, 22') which is durably connected over its entire surface with the first closing flap for the purpose of an increased rigidity;

c) the first closing flap is movable into an opening position for forming a package opening;

d) the package comprises reinforcement strips (15, 23, 38, 40, 15', 23', 38', 40') of the end, rear and front walls, said reinforcement strips being situated on edges which are adjacent to the top wall;

e) the reinforcement strip (15) of the rear wall is formed by a continuation of the reinforcement sheet (16, 22') of the first closing flap; and f) the reinforcement strips (38, 40, 38', 40') of the edges of the end walls are formed by a continuation of the reinforcement strips (15, 23) of the edges of the front wall (20, 20') or rear wall (18, 18').

2. The package according to claim 1, wherein layers which reinforce the first closing flap (17, 48) are formed by folding over edges (14, 14') of the blank against the first closing flap.

3. The package according to claim 2, wherein said strips are formed by folding over edge portions (15, 23, 15', 23') of the blank (12, 12') inwards and beyond the first closing flap (17, 48).

4. The package according to claim 1, wherein, for forming the top wall (44*a*), there are the first closing flap (17) and a second closing flap (21) provided, each of the closing flaps having one reinforcement sheet (16, 22) and a respective one of the reinforcement strips (15, 23) adjoined thereto, the first closing flaps (17) being attached to the rear wall (18) by a hinge line (24), and the second closing flap (21) being attached to the front wall (20) by a hinge line (25).

5. The package according to claim 4, wherein the reinforcement sheets (16, 22) are formed from several interconnected, adhesively bonded layers of the paper blank (12).

6. The package according to claim, 4, wherein one of the closing flaps (17) is larger than the other and extends across the entire surface of the top wall (44*a*) and comes to rest on the smaller closing flap (21) when the package is closed.

7. The package according to claim 4, wherein the closing flaps (17, 21) lie in the plane of the top wall (44*a*) are connected to one another by means of releasable adhesive bonding when the package is closed.

8. The package according to claim 4, wherein the closing flaps (17, 21), including the corresponding closing flap reinforcement sheets (16, 22), are severable from the rear wall and the front wall, respectively, along perforated folding lines (30, 31) or hinge lines (24, 25).

9. The package according to claim 4, wherein the free edges of the closing flaps (17, 21) have multiple layers formed by inwardly folded reinforcement tabs (37, 39) so that altogether four layers are formed including the closing flap reinforcement sheets (16, 22).

10. The package according to claim 1, wherein, for forming the top wall (44*a*′), a closing flap (48) which is connected to the rear wall (18′) is provided, and said closing flap (48) has an insertion flap (52) arranged on a folding line (56) of said closing flap (48) which faces the front wall (20′), and said insertion flap (52) assumes a position between the contents of the package and the front wall (20′) when the package is closed, and has an insertion flap reinforcement (53) adjoining the closing flap reinforcement sheet (22′).

11. The package as claimed in claim 1, wherein the end walls are formed from tabs (33, 35, 36, 33′, 35′, 36′) respectively connected to the front wall (20), bottom wall (19, 19′) and rear wall (18, 18′), which results in the formation of at least three superimposed layers, and in the region of the reinforcement strips (40, 38, 40′,

12. A cuboid bundle package for cigarette cartons, formed from a paper blank (12) which completely surrounds contents of the package and forms a top wall (44*a*) a from wall (20), a rear wall (18), a bottom wall (19) and end walls, wherein:

a) the package comprises a first closing flap and a second closing flap (17, 21, 86), attached, respectively, to the rear wall (18, 18′) and the front wall (20), for forming the top wall (44*a*);

b) the first closing flap, which come to rest in the plane of the top wall (44*a*) when the package is closed, has a reinforcement sheet (16) which is durably connected over its entire surface with the first closing flap for the purpose of an increased rigidity;

c) the closing flaps are movable into an opening position for forming a package opening;

d) the package comprises reinforcement strips (15, 23, 38, 40) of the rear and front walls, said reinforcement strips being arranged on edges which are adjacent to the top wall;

e) the reinforcement strip (15) of the rear wall is formed by a continuation of the reinforcement sheet (16) of the first closing flap; and f) wherein, for forming the top wall (44*a*), each of the first and second closing flaps (17, 21) has one reinforcement sheet (16, 22) and a respective one of the reinforcement strips (15, 23) adjoined thereto, the first closing flap (17) being attached to the rear wall (18) by a hinge line (24), and the second closing flap (21) being attached to the from wall (20) by a hinge line (25); and g) the reinforcement strip (23) of the front wall is formed by a continuation of the reinforcement sheet (22) of the second closing flap.

13. A blank (12, 12′), made from paper, for forming a cuboid package for cigarette cartons, wherein:

a) within a rectangular basic area of the blank, there is arranged a rectangular bottom wall (19, 19′) having a longitudinal extent which is perpendicular to a longitudinal extent of the blank;

b) in a longitudinal direction of the blank there is arranged a rear wall (18, 18′) on one side of the bottom wall (19, 19′) and a front wall (20, 20′) on another side of the bottom wall (19, 19′);

c) in the longitudinal direction of the blank, the rear wall (18, 18′) is adjoined by a closing flap (17, 48) via a folding line (24), the closing flap being just as long, in a direction transverse relative to the longitudinal direction of the blank, as the rear wall, bottom wall, and front wall, respectively;

d) for forming end walls of the package, the front wall, bottom wall, and the closing flap (17, 48), in longitudinal directions thereof, transverse relative to the longitudinal direction of the blank, are adjoined by end tabs (36, 35, 33, 39, 36′, 35′, 33′, 39′) on each side;

e) the closing flap (17, 48) is adjoined, in the longitudinal direction of the blank, by a closing flap reinforcement (16, 22′) and a lateral reinforcement (15, 23′) which is connected to the closing flap reinforcement (16, 22′) via a folding line (30);

f) the lateral reinforcement (15, 23′) extends across the entire width of the blank, in the transverse direction thereof and parallel to the rear wall (18, 18′), and has edge tabs (40, 40′) parallel to the end tabs; and g) the closing flap (17, 48) and the closing flap reinforcement (16, 22′) are of equal width, in the longitudinal direction of the blank, with a folding line disposed in between, so that, when the closing flap reinforcement is folded onto the closing flap, the lateral reinforcement (15, 23′) reinforces the rear wall (18, 18′) near the folding line and, at the same time, ones of the end tabs which are adjoined to the rear wall (18, 18′) are reinforced by the edge tabs (40, 40′).

* * * * *